US011333381B2

(12) United States Patent
Taira

(10) Patent No.: US 11,333,381 B2
(45) Date of Patent: May 17, 2022

(54) DETERMINATION DEVICE

(71) Applicant: DAIKIN INDUSTRIES, LTD., Osaka (JP)

(72) Inventor: Shigeharu Taira, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 15/749,654

(22) PCT Filed: Jul. 28, 2016

(86) PCT No.: PCT/JP2016/072231
§ 371 (c)(1),
(2) Date: Feb. 1, 2018

(87) PCT Pub. No.: WO2017/022642
PCT Pub. Date: Feb. 9, 2017

(65) Prior Publication Data

US 2018/0231267 A1 Aug. 16, 2018

(30) Foreign Application Priority Data

Aug. 3, 2015 (JP) ..... JP2015-153149

(51) Int. Cl.
*F24F 11/38* (2018.01)
*F24F 11/89* (2018.01)
(Continued)

(52) U.S. Cl.
CPC ..... *F24F 11/38* (2018.01); *F24F 11/56* (2018.01); *F24F 11/63* (2018.01); *F24F 11/89* (2018.01);
(Continued)

(58) Field of Classification Search
CPC .... F25B 9/002; F25B 49/02; F25B 2345/003; F25B 43/04; F25B 43/043; F24F 11/38; F24F 11/63; F24F 11/56
See application file for complete search history.

(56) References Cited

U.S. PATENT DOCUMENTS 5,214,931 A * 6/1993 Paige ..... F25B 41/30 62/125
5,295,367 A * 3/1994 Keltner ..... B60H 1/00585 417/234
(Continued)

FOREIGN PATENT DOCUMENTS

CN 1906453 A 1/2007
EP 1 914 493 A2 4/2008
(Continued)

OTHER PUBLICATIONS

DES—Environmental Fact Sheet, p. 2 (Year: 2009).*

*Primary Examiner* — Lionel Nouketcha
(74) *Attorney, Agent, or Firm* — Birch, Stewart, Kolasch & Birch, LLP

(57) ABSTRACT

A determination device includes a refrigerant circuit, an operation determination unit, and a refrigerant determination unit. The refrigerant circuit is made of a compressor, a condenser, an expansion mechanism, and an evaporator that are circularly connected. In a refrigeration cycle operation in accordance with a quantity of heat required by the condensers or the evaporators, the operation determination unit determines whether the refrigeration cycle operation can be normally carried out or not. Upon determination that the refrigeration cycle operation cannot be normally carried out, the refrigerant determination unit determines whether a refrigerant in the refrigerant circuit is regenerable or not, based on a result of the determination. Thus the determination device is provided by which an effort involved with determination as to whether the refrigerant is regenerable or not can be reduced.

6 Claims, 6 Drawing Sheets

(51) Int. Cl.

| | |
|---|---|
| ***F25B 49/00*** | (2006.01) |
| ***F24F 11/63*** | (2018.01) |
| ***F24F 11/56*** | (2018.01) |
| *F25B 45/00* | (2006.01) |
| *F25B 13/00* | (2006.01) |

(52) U.S. Cl.

CPC ..... *F25B 49/005* (2013.01); *F25B 13/00* (2013.01); *F25B 45/00* (2013.01); *F25B 2313/0253* (2013.01); *F25B 2400/08* (2013.01); *F25B 2400/19* (2013.01); *F25B 2500/19* (2013.01); *F25B 2700/151* (2013.01); *F25B 2700/1931* (2013.01); *F25B 2700/21152* (2013.01)

(56) References Cited

U.S. PATENT DOCUMENTS

| | | | | |
|---|---|---|---|---|
| 5,412,955 | A * | 5/1995 | Husarik | B60H 1/00585 62/149 |
| 6,408,637 | B1 * | 6/2002 | Hanson | B01D 1/14 62/292 |
| 7,076,995 | B2 * | 7/2006 | Taira | G01N 33/2888 73/61.41 |
| 2003/0010044 | A1 * | 1/2003 | Taira | F04B 39/0207 62/127 |
| 2007/0089440 | A1 * | 4/2007 | Singh | F25B 49/005 62/129 |
| 2007/0156373 | A1 | 7/2007 | Yamashita et al. | |

FOREIGN PATENT DOCUMENTS

| | | | |
|---|---|---|---|
| EP | 2 264 386 | A1 | 12/2010 |
| EP | 2 960 598 | A1 | 12/2015 |
| GB | 2 223 330 | A | 4/1990 |
| JP | 03-071042 | A | 3/1991 |
| JP | 11-051512 | A | 2/1999 |
| JP | 2003-262437 | A | 9/2003 |
| JP | 2005-291702 | A | 10/2005 |
| JP | 2005291702 | A * | 10/2005 |
| JP | 2008-175751 | A | 7/2008 |
| JP | 2012-237472 | A | 12/2012 |
| JP | 2015-004473 | A | 1/2015 |

* cited by examiner

DETERMINATION DEVICE

TECHNICAL FIELD

The present invention relates to a determination device.

BACKGROUND ART

Among conventional refrigerating devices is a multiple type air conditioning machine disclosed in JP2015-4473 A (PTL 1). The multiple type air conditioning machine includes one outdoor unit and a plurality of indoor units connected to the one outdoor unit through branch pipes.

The outdoor unit includes a compressor that compresses a refrigerant. Flow or the refrigerant compressed by the compressor is controlled by a four-way switching valve. In a cooling operation, more specifically, the refrigerant is delivered from the compressor to an outdoor heat exchanger of the outdoor unit and the outdoor heat exchanger functions as a condenser. In a heating operation, the refrigerant is delivered from the compressor to an indoor heat exchanger of each indoor unit and the indoor heat exchanger functions as a condenser.

Thus the outdoor heat exchanger and the indoor heat exchangers form portions of a refrigerant circuit through which the refrigerant flows.

CITATION LIST

Patent Literature

PTL1: JP 2015-4473 A

SUMMARY OF INVENTION

Technical Problem

When the multiple type air conditioning machine is disposed of, it is desirable to reuse the refrigerant in the refrigerant circuit in order to reduce wastes and to effectively utilize resources. For reuse of the refrigerant, ordinarily, the refrigerant in the refrigerant circuit is initially collected into a refrigerant collection cylinder. Then the refrigerant collection cylinder is brought into a regeneration plant that is far from a place where the refrigerant circuit is installed and the regeneration plant is requested to regenerate the refrigerant in the refrigerant collection cylinder. As a result, an analysis on a degree of deterioration of the refrigerant is performed at the regeneration plant and, when the deterioration is not remarkable, the refrigerant is regenerated by distillation refining. When it is determined based on the analysis that the deterioration is remarkable, the refrigerant is broken down.

Thus a problem is caused in that it takes a lot of effort to know whether the refrigerant is regenerable or not, because it is needed to go to the regeneration plant that is far from the place where the refrigerant circuit is installed.

An object of the invention is to provide a determination device by which the effort involved with determination as to whether the refrigerant is regenerable or not can be reduced.

Solution to Problem

The invention provides a determination device including a refrigerant circuit in which a compressor, condenser, an expansion mechanism, and an evaporator are circularly connected, an operation determination unit which determines in a refrigeration cycle operation whether the refrigeration cycle operation can be normally carried out or not, and a refrigerant determination unit which determines, upon determination that the refrigeration cycle operation cannot normally carried out, whether a refrigerant is the refrigerant circuit is regenerable or not.

According to this configuration, upon the determination that the refrigeration cycle operation cannot be normally carried out, the refrigerant determination unit determines whether the refrigerant in the refrigerant circuit is regenerable or not, based on the result of the determination. As a result, it can be determined whether the refrigerant is regenerable or not, in a vicinity of a place where the refrigerant circuit is installed, without travel to a regeneration plant that is far from the place where the refrigerant circuit is installed. Accordingly, an effort involved with determination as to whether the refrigerant is regenerable or not can be reduced.

A determination device in accordance with an aspect further includes a collecting action prohibition unit which prohibits an action or collecting the refrigerant when it is determined that the refrigerant is unregenerable.

By provision of the collecting action prohibition unit, the refrigerant that is determined as unregenerable refrigerant can be prevented from being collected and being subjected to regeneration processing by mistake.

A determination device in accordance with an aspect further includes a storage unit which stores information indicating that the refrigerant is unregenerable, when it is determined that the refrigerant is unregenerable.

Provision of the storage unit enables accumulation of the information indicating that the refrigerant unregenerable. Consequently, the information can be retrieved from the storage unit when necessary and can be utilized for appropriate handling in repair, maintenance, or the like.

In a determination device in accordance with an aspect, the refrigerant determination unit determines that the refrigerant is unregenerable, when it is determined that the refrigeration cycle operation cannot be normally carried out due to an abnormality relating to the compressor.

In case where the refrigeration cycle operation cannot be normally carried out due to the abnormality relating to the compressor, the refrigerant has often deteriorated so as not to be suitable for regeneration. Thus reliability of determination that is made by the refrigerant determination unit can be increased.

A determination device in accordance with an aspect further includes a communication device which transmits the information indicating that the refrigerant is unregenerable, to an external terminal, when it is determined that the refrigerant is unregenerable.

Provision of the communication device makes it possible to quickly notify outside that the refrigerant is unregenerable.

A determination device in accordance with an aspect is an air conditioning machine and the external terminal is a computer of a service center.

The information indicating that the refrigerant is unregenerable is transmitted to the computer of the service center and thus the service center can be urged to do maintenance.

In a determination device in accordance with an aspect, the external terminal is a mobile device of a user.

The information indicating that the refrigerant is unregenerable is transmitted to the mobile device of the user and thus the service center can be urged to do the maintenance.

In a determination device or an air conditioning machine in accordance with an aspect, the communication device wirelessly transmits the information to the external terminal.

The information is wirelessly transmitted to the external terminal and thus a degree of freedom of installation of the external terminal can be increased.

Advantageous Effects of Invention

The determination device of the invention includes the operation determination unit and the refrigerant determination unit and thus the effort involved with the determination as to whether the refrigerant is regenerable or not can be reduced.

DESCRIPTION OF EMBODIMENTS

Hereinbelow, embodiments of the invention will be described with reference to the accompanying drawings.

First Embodiment

Figure 1:
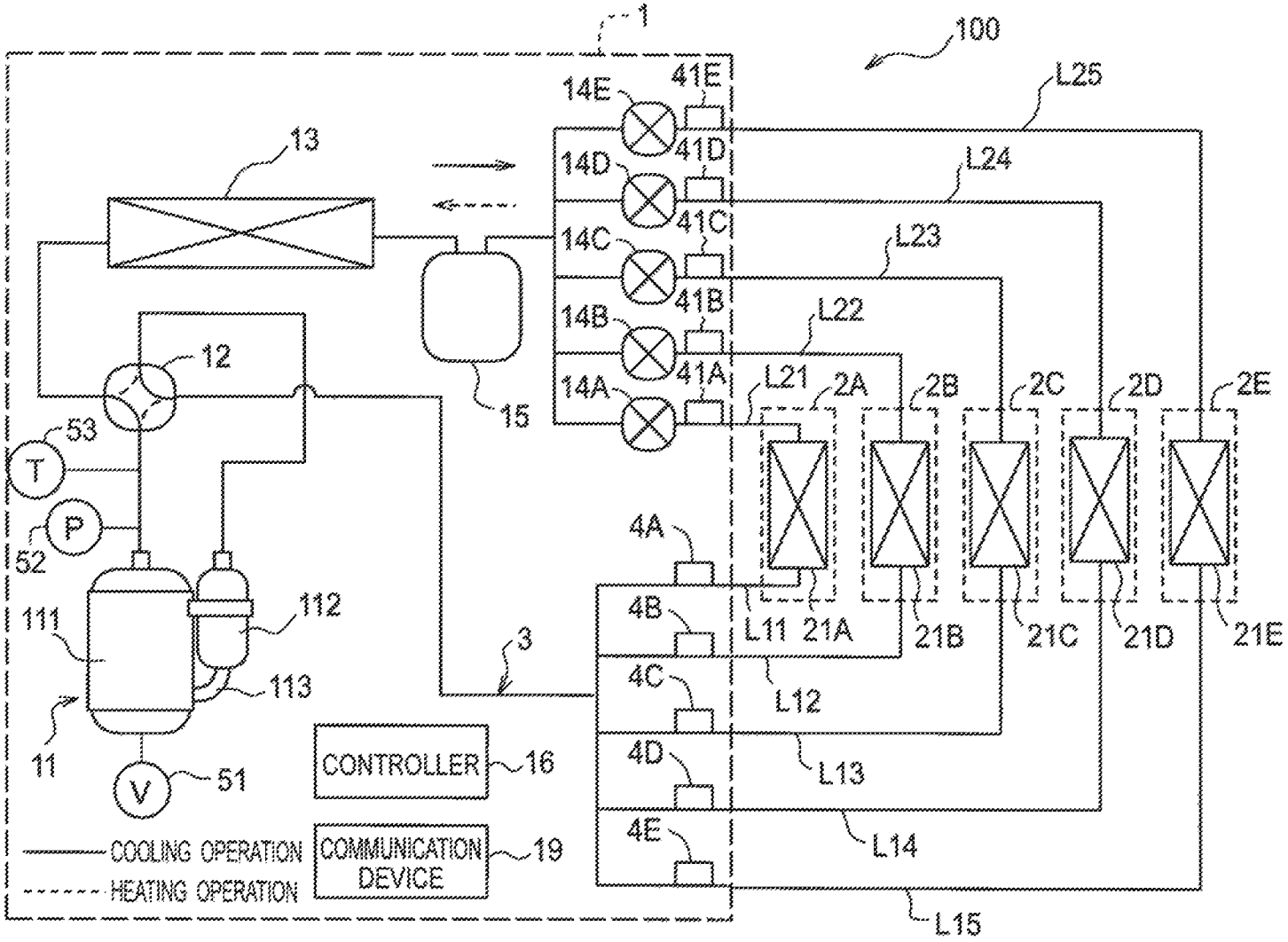
FIG. 1 is a circuit diagram illustrating a multiple type air conditioning machine is accordance with a first embodiment of the invention.

FIG. 1 is a circuit diagram illustrating a multiple type air conditioning machine 100 in accordance with a first embodiment of the invention. The multiple air conditioning machine 100 is an example of a determination device 100.

The air conditioning machine includes one outdoor unit 1, a plurality of indoor units 2A, 2B, 2C, 2D, and 2E, and a refrigerant circuit 3 through which a refrigerant flows. R22 refrigerant is used as the refrigerant, for instance. As an example of the refrigerant, mixed refrigerants, such as R410A refrigerant, containing R32, R32 single refrigerant, a low-GWP (Global Warming Potential) refrigerant, or the like may be used.

The outdoor unit 1 includes a compressor 11, a four-way switching valve 12 of which one end is connected to a discharge side of the compressor 11, an outdoor heat exchanger 13 of which one end is connected to another end of the four-way switching valve 12, expansion valves 14A, 14B, 14C, 14D, and 14E that expand the refrigerant, a receiver 15 as an example of a refrigerant collection container, and a controller 16. An outdoor blower fan (not illustrated) that blows air to the outdoor heat exchanger 13 is provided in the outdoor unit 1. The expansion valves 14A, 14B, 14C, 14D, and 14E are an example of expansion mechanisms in accordance with the invention.

The indoor units 2A, 2B, 2C, 2D, and 2E respectively include indoor heat exchangers 21A, 21B, 21C, 21D, and 21E. The indoor heat exchangers 21A, 21B, 21C, 21D, and 21E are provided in the refrigerant circuit 3 and form principal parts on an indoor side of the refrigerant circuit 3. Indoor blower fans (not illustrated) that blow air to the indoor heat exchangers 21A, 21B, 21C, 21D, and 21E are provided in the indoor units 2A, 2B, 2C, 2D, and 2E, respectively. The indoor units 2A, 2B, 2C, 2D, and 2E may be of wall-hanging type or may be of ceiling-embedded type. On condition that the indoor units 2A, 2B, 2C, 2D, and 2E are of ceiling-embedded type, cool air or warm air from the indoor units 2A, 2B, 2C, 2D, and 2E may be directly supplied into rooms or may be supplied through ducts into the rooms.

The compressor 11 includes a compressor body 111 that houses a motor (not illustrated) and the like, on the discharge side, and an accumulator 112, on a suction side. Along with the four-way switching valve 12, the outdoor heat exchanger 13, the expansion valves 14A, 14B, 14C, 14D, and 14E, and the receiver 15, the compressor 11 forms a principal part on an outdoor side of the refrigerant circuit 3. The compressor body 111 may be of any of rotary type, swing type, scroll type, and the like.

A voltage sensor 51 is provided in the compressor 11 and is capable of detecting a supply voltage for the compressor body 111. A pressure sensor 52 and a temperature sensor 53 are provided on the discharge side of the compressor 11 and are respectively capable of detecting a discharge pressure and a discharge temperature of air discharged from the compressor body 111. Such detected values are outputted to the controller 16.

Figure 2:
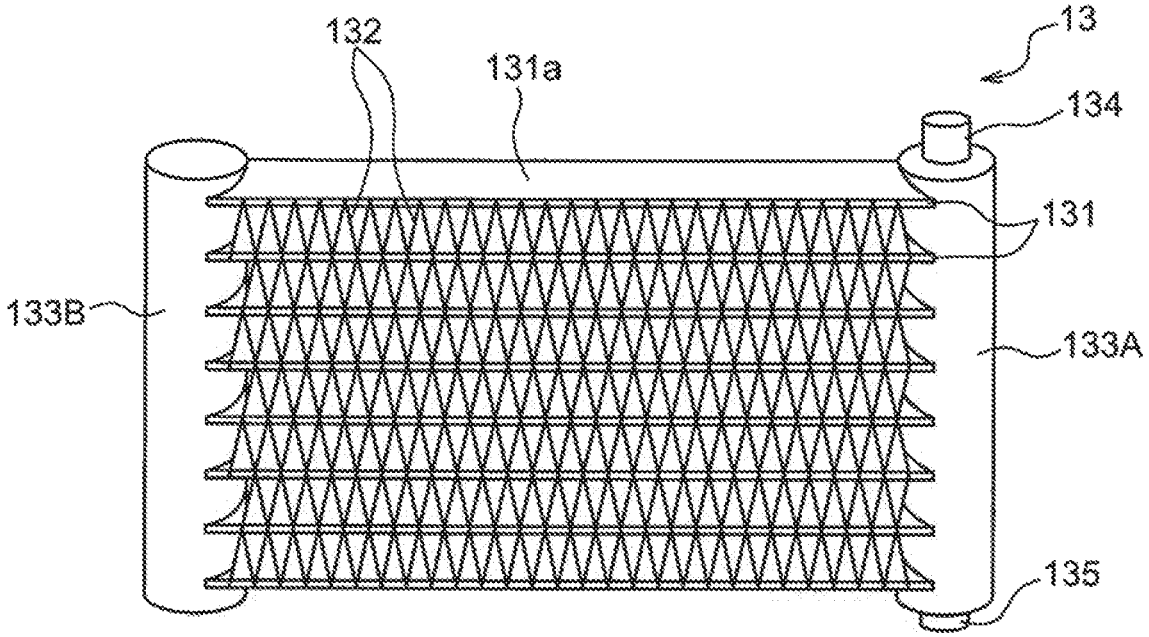
FIG. 2 is an external perspective view of an outdoor heat exchanger in FIG. 1.

As illustrated in FIG. 2, the outdoor heat exchanger 13 is a heat exchanger in which flattened tubes 131 are used as heat transfer tubes. More specifically, the outdoor heat exchanger 13 is a stacked heat exchanger and primarily includes the flattened tubes 131, corrugated fins 132, and first and second headers 133A and 133B.

The flattened tubes 131 are formed of aluminum or aluminum alloy and each include a planar part 131*a* which forms heat transfer surfaces and a plurality of inner channels (not illustrated) through which the refrigerant flows. The flattened tubes 131 are arranged at a plurality of levels so as to be stacked with intervals (ventilation spaces) therebetween in a state in which the planar parts 131*a* face upward and downward.

The corrugated fins 132 are fins bent into corrugated shapes and made of aluminum or aluminum alloy. The corrugated fins 132 are placed in the ventilation spaces between the flattened tubes 131 that vertically adjoin and have valley parts and peak parts in contact with the planar parts 131*a* of the flattened tubes 131. The valley parts and the peak parts are joined to the planar parts 131*a* by brazing or the like.

The first and second headers 133A and 133B are connected to both ends of each of the flattened tubes 131 that are arranged vertically at the plurality of levels. The first and second headers 133A and 133B have a function of supporting the flattened tubes 131, a function of guiding the refrigerant into the inner channels in the flattened tubes 131, and a function of aggregating the refrigerant that comes out of the inner channels.

When the outdoor heat exchanger 13 functions as a condenser for the refrigerant, the refrigerant that flows in through a first opening 134 of the first header 133A is distributed evenly in general into the inner channels in the uppermost flattened tube 131 and then flows toward the second header 133B. The refrigerant that reaches the second header 133B is distributed evenly into the inner channels in the second-level flattened tube 131 and then flows toward the first header 133A. Subsequently, the refrigerant in the flattened tubes 131 at odd-numbered levels flows toward the second header 133B and the refrigerant in the flattened tubes 131 at even-numbered levels flows toward the first header 133A. The refrigerant in the flattened tube 131 at the lowermost and even-numbered level flows toward the first header 133A, aggregates in the first header 133A, and flows out through a second opening 135 of the first header 133A.

When the outdoor heat exchanger 13 functions as the condenser for the refrigerant, the refrigerant that flows in the flattened tubes 131 radiates heat through the corrugated fins 132 into air flow that flows through the ventilation spaces.

When the outdoor heat exchanger 13 functions as an evaporator for the refrigerant, by contrast, the refrigerant flows in through the second opening 135 of the first header 133A, flows through the flattened tubes 131 and the first and second headers 133A and 133B in directions opposite to directions for a function as the condenser for the refrigerant, and thereafter flows out through the first opening 134 of the first header 133A.

When the outdoor heat exchanger 13 functions as the evaporator for the refrigerant, the refrigerant that flows in the flattened tubes 131 absorbs heat through the corrugated fins 132 from the air flow that flows through the ventilation spaces.

One end of the accumulator 112 is connected through a connecting tube 113 to the compressor body 111. That is, inside of the accumulator 112 communicates through the connecting tube 113 with inside of the compressor body 111.

The other end of the accumulator 112 is connected through the four-way switching valve 12 to one end of each of the indoor heat exchangers 21A, 210, 210, 210, and 210. Interconnecting pipes L11, L12, L13, L14, and L15 guide the refrigerant between the four-way switching valve 12 and the indoor heat exchangers 21A, 21B, 21C, 21D, and 21E, respectively.

Temperature sensors 4A, 4B, 4C, 4D, and 4E are respectively attached onto the interconnecting pipes L11, L12, L13, L14, and L15. The temperature sensors 4A, 4B, 4C, 4D, and 4E respectively detect temperatures of the refrigerant in the interconnecting pipes L11, L12, L13, L14, and L15 and output signals indicating the temperatures to the controller 16.

The other end of each of the indoor heat exchangers 21A, 21B, 21C, 21D, and 21E is connected to one end of each of the expansion valves 14A, 14B, 14C, 14D, and 14E through an interconnecting pipe L21, L22, L23, L24, or L25. That is, the interconnecting pipes L21, L22, L23, L24, and L25 guide the refrigerant between the expansion valves 14A, 14B, 14C, 14D, and 14E and the indoor heat exchangers 21A, 21B, 210, 210, and 21E, respectively.

Temperature sensors 411, 41B, 41C, 41D, and 41E are respectively attached onto parts of the interconnecting pipes 121, 122, 123, 124, and 125 that are adjacent to the expansion valves 14A, 14B, 14C, 14D, and 14E. The temperature sensors 41A, 41B, 41C, 41D, and 41E respectively output to the controller 16 signals indicating temperatures of the refrigerant in the interconnecting pipes L21, L22, L23, L24, and L25.

The other end of each of the expansion valves 14A, 14B, 14C, 14D, and 14E is connected through the receiver 15 to the other end of the outdoor heat exchanger 13.

The receiver 15 is detachably provided in the refrigerant circuit 3 so that the refrigerant flows through the receiver 15 in cooling operation and a heating operation. The receiver 15 is provided in the outdoor unit 1. The cooling operation and the heating operation are carried out in accordance with a quantity of heat required by the indoor heat exchangers 21A, 21B, 21C, 21D, and 21E. The cooling operation and the heating operation are examples of the refrigeration cycle operation.

The controller 16 is made of microcomputers, input/output circuits, and the like and controls the compressor 11, the four-way switching valve 12, the expansion valves 14A, 14B, 14C, 14D, and 14E, and the like. For instance, the controller 16 controls a position of a valving element (not illustrated) in the four-way switching valve 12 so that the refrigerant in the four-way switching valve 12 flows along solid lines in the cooling operation and so that the refrigerant in the four-way switching valve 12 flows along dashed lines in the heating operation.

In the cooling operation, accordingly, the outdoor heat exchanger 13 operates as an example of the condenser and the indoor heat exchangers 21A, 21B, 21C, 21D, and 21E operate as an example of the evaporators. In the heating operation, the outdoor heat exchanger 13 operates as an example of the evaporator and the indoor heat exchangers 21A, 21B, 21C, 21D, and 21E operate as an example of the condensers.

Alterations in operating condition such as switching between the cooling operation and the heating operation are made with use of a remote control not illustrated. When a specified error that will be described later is detected, contents of the error are outputted to the remote control by the controller 16.

The multiple type air conditioning machine 100 in accordance with the embodiment includes a communication device 19. When the specified error is detected, the communication device 19 receives signals from the controller 16 and wirelessly transmits the contents to outside. A destination is a computer 18A of a service center, a mobile device 18B of a user, or the like, for instance.

The remote control and the communication device 19, however, are not essential components and aspects thereof may be any desired aspects.

In FIG. 1, an arrow of solid line designates a direction in which the refrigerant in the refrigerant circuit 3 flows in the cooling operation and an arrow of dashed line designates a direction in which the refrigerant in the refrigerant circuit 3 flows in the heating operation.

Figure 3:
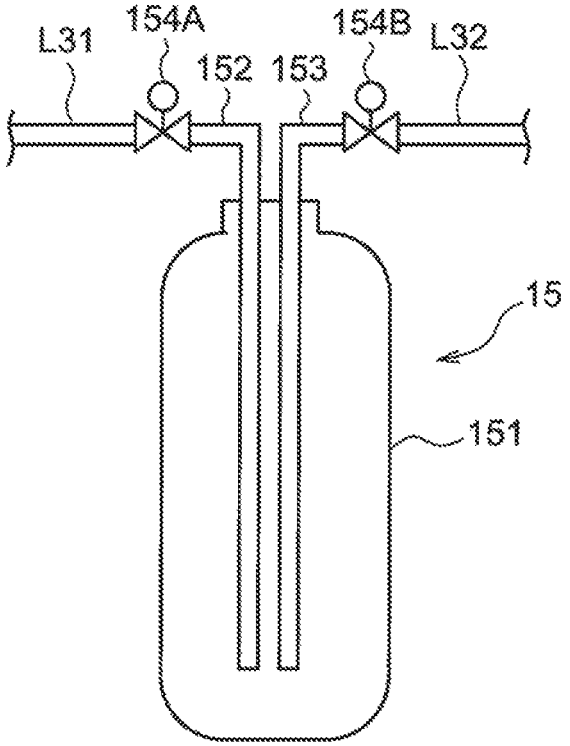
FIG. 3 is a configuration of a receiver in the multiple type air conditioning machine.

FIG. 3 is a diagram illustrating a configuration of the receiver 15.

The receiver 15 includes a receiver body 151 that retains the refrigerant, an outdoor-heat-exchanger side connecting pipe 152, an expansion-valve side connecting pipe 153, and first and second stop valves 154A and 154B. The receiver body 151 is an example of a container body.

One end of the outdoor-heat-exchanger side connecting pipe 152 is placed in the receiver body 151. The other end of the outdoor-heat-exchanger side connecting pipe 152 is placed out of the receiver body 151 and is connected to one end of the first stop valve 154A.

One end of the expansion-valve side connecting pipe 153 is placed in the receiver body 151 and on generally the same level as the one end of the outdoor-heat-exchanger side connecting pipe 152. The other end of the expansion-valve side connecting pipe 153 is placed out of the receiver body 151 and is connected to one end of the second stop valve 154B.

The other end of the first stop valve 154A is connected through a pipe L31 to the other end of the outdoor heat exchanger 13. Bolts (not illustrated) and nuts (not illustrated) are used for connection between the first stop valve 154A and the pipe L31 so that the first stop valve 154A can be separated from the pipe L31 by loosening of the bolts and the nuts. That is, the connection between the first stop valve 154A and the pipe L31 is flange connection.

The other end of the second stop valve 154B is connected through a pipe L32 to the other end of each of the expansion valves 14A, 14B, 14C, 14D, and 14E. Bolts (not illustrated) and nuts (not illustrated) are used for connection between the second stop valve 154B and the pipe L32 so that the second stop valve 154B can be separated from the pipe L32 by loosening of the bolts and the nuts. That is, the connection between the second stop valve 154B and the pipe L32 is the flange connection.

The receiver 15 in accordance with the embodiment is detachably provided in the refrigerant circuit 3 as above and, when the refrigerant is collected from the refrigerant circuit 3, the refrigerant can be collected by gathering of the refrigerant in the refrigerant circuit 3 into the receiver 15 and subsequent detachment of the receiver 15 from the refrigerant circuit 3. Accordingly, an operator can avoid bringing a refrigerant collection cylinder, for instance, to a place where the refrigerant circuit 3 exists. As a result, a load of an operation for collecting the refrigerant can be reduced. The receiver 15, however, does not have to be detachable and therefore the first and second stop valves 154A and 154B are not essential.

Figure 4:
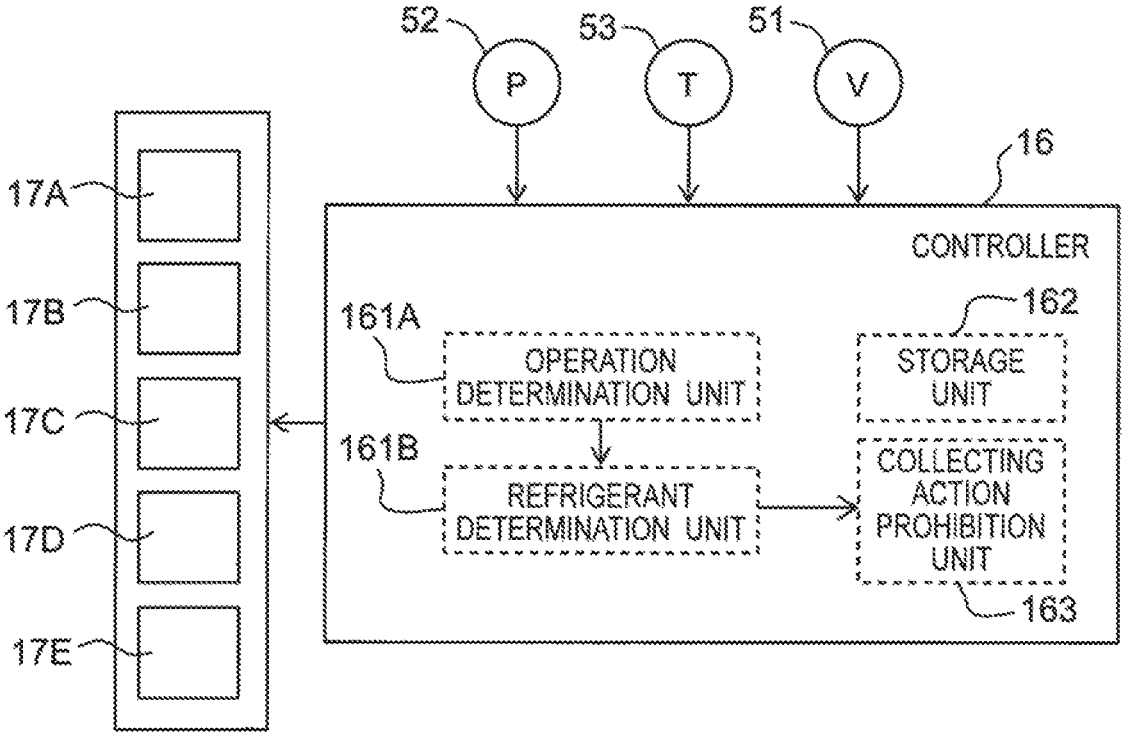
FIG. 4 is a block diagram illustrating a control section of the multiple type air conditioning machine.

FIG. 4 is a block diagram illustrating a control section of the multiple type air conditioning machine 100. The control section in FIG. 4 that will be described herein is merely an example and there is no limitation to that.

The controller 16 includes an operation determination unit. 161A and a refrigerant determination unit 161B. The controller 16 receives signals on the various detected values for the controller 16 from the voltage sensor 51, the pressure sensor 52, and the temperature sensor 53, processes the signals on the detected values in the operation determination unit 161A and the refrigerant determination unit 161B, and thereafter outputs processing results to remote controls 17A, 17B, 17C, 17D, and 17E. Though output destinations in the embodiment are the remote controls 17A, 17B, 17C, 17D, and 17E that control operations of the multiple type air conditioning machine 100, output monitors or the like may be newly provided, for instance, without limitation to the embodiment.

Various detected values are outputted from various sensors such as the voltage sensor 51, the pressure sensor 52, and the temperature sensor 53 to the controller 16. Then the operation determination unit 161A determines whether the cooling operation or the heating operation can be carried out. Upon determination by the operation determination unit 161A that the cooling operation or the heating operation cannot be normally carried out, the refrigerant determination unit 161B determines whether the refrigerant in the refrigerant circuit 3 is regenerable or not, based on a result of the determination. The result of the determination by the refrigerant determination unit 161B is outputted to the remote controls 17A, 17B, 17C, 17D, and 17E. Thus it is indicated on indication units of the remote controls that the refrigerant is regenerable or that the refrigerant is unregenerable.

For determination as to whether the refrigerant regenerable or not, ordinarily, the refrigerant is directly analyzed. When results of such analysis indicate that the refrigerant is conspicuously oxidized or that the refrigerant is contaminated with a large amount of impurities, it is determined that the refrigerant is not suitable for the regeneration and the refrigerant is disposed of.

The inventor found that the refrigerant was in a state unsuitable for the regeneration in cases where there occurred a specified error in which an abnormality was detected in the detected values from the voltage sensor 51, the pressure sensor 52, and the temperature sensor 53, for instance, and completed the operation determination unit 161A and the refrigerant determination unit 161B. In cases where a failure in the four-way switching valve 12, another abnormality relating to the compressor 11, an abnormal temperature relating to the outdoor heat exchanger 13, or the like is detected as well, other than the cases where the abnormality in the detected values is detected, it may be determined that the refrigerant is in the state unsuitable for the regeneration. In terms of reliability, however, it is desirable to determine that the refrigerant is in the state unsuitable for the regeneration, based on detection of the abnormality in the detected values.

Thus it can be checked whether the refrigerant is regenerable or not and it can be accordingly determined whether to regenerate the refrigerant or to dispose of the refrigerant, in accordance with the results of the determination indicated on the remote controls 17A, 17B, 17C, 17D, and 17E based on the errors. As a result, it can be determined whether the refrigerant is regenerable or not, in a vicinity of a place where the refrigerant circuit is installed, without travel to a regeneration plant that is far from the place where the refrigerant circuit 3 is installed. Accordingly, an effort involved with the determination as to whether the refrigerant is regenerable or not can be reduced.

A storage unit 162 is provided in the controller 16. The storage unit 162 is made of a nonvolatile memory and stores information indicating that the refrigerant is unregenerable as the results of the determination by the operation determination unit 161A and the refrigerant determination unit 161B.

Provision of the storage unit 162 enables accumulation of the information indicating that the refrigerant is unregenerable. Consequently, the information can be retrieved when necessary and can be utilized for appropriate handling in repair, maintenance, or the like.

A collecting action prohibition unit 163 is provided in the controller 16. The collecting action prohibition unit 163 prohibits an action of collecting the refrigerant when the refrigerant determination unit 161B determines that the refrigerant is unregenerable. Specifically, when a service provider or the like collects the refrigerant, the compressor 11 is operated with the expansion valves 14A, 14B, 14C, 14D, and 14E closed, so that the refrigerant is retained in and collected into the receiver 15 without being circulated. By activation of the collecting action prohibition unit 163, however, an operation of the compressor 11 for performing the collecting action can be prevented from starting. Consequently, the action of collecting the refrigerant is not started and collection of the refrigerant can be prohibited. On condition that the multiple type air conditioning machine 100 has a refrigerant collection mode or the like, execution of the mode may be prohibited by the activation of the collecting action prohibition unit 163. In a configuration in which the receiver 15 is a detachable mechanism as in the embodiment, the receiver 15 may be locked so that the receiver 15 cannot be detached. Operations of the collecting action prohibition unit 163 that are enumerated herein are examples and aspects thereof are not limited to those examples but have only to be capable of substantially prohibiting the collection of the refrigerant.

By such provision of the collecting action prohibition unit 163, the refrigerant that is determined as unregenerable refrigerant can be prevented from being collected and being subjected to regeneration processing by mistake.

Though the collecting action prohibition unit 163 and the storage unit 162 that have been described herein are provided as software in the controller 16, the units may be provided as hardware separately from the controller without limitation to the above. Provision as the software, however, is preferable in terms of cost reduction, downsizing, and the like.

Figure 5:
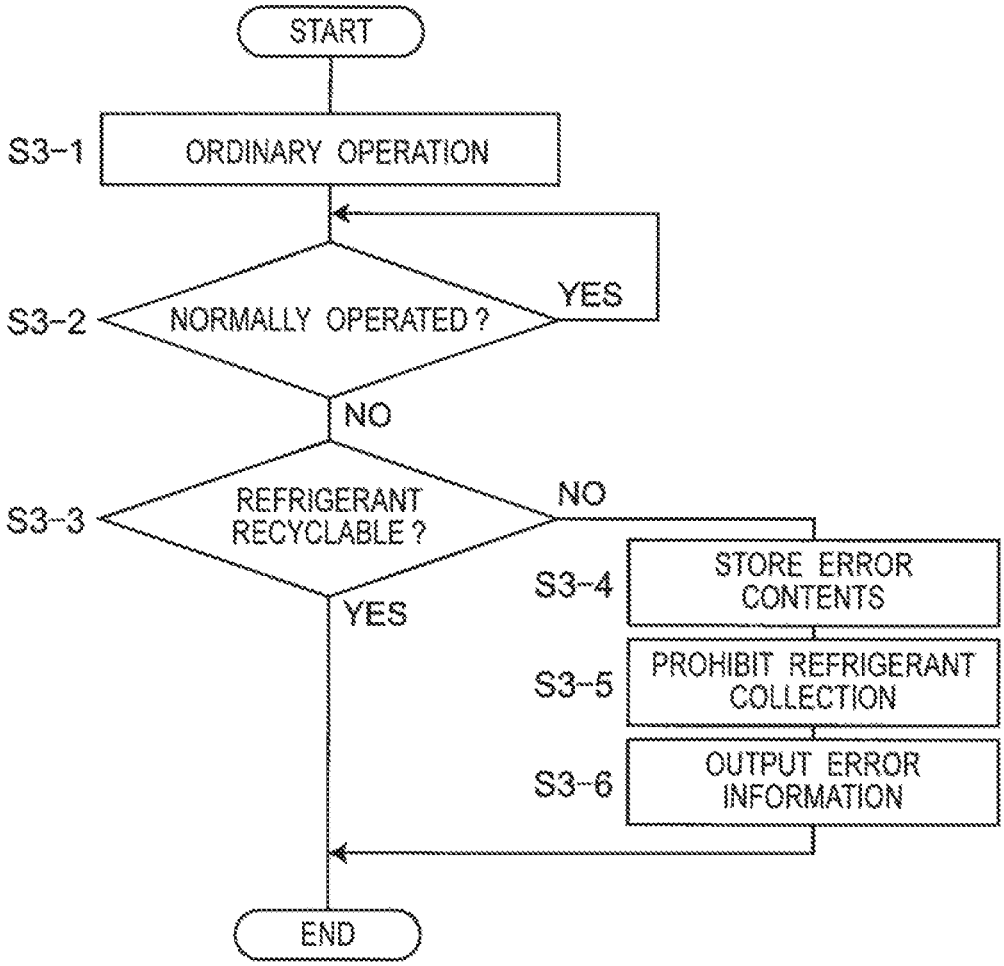
FIG. 5 is a flow chart illustrating an example of control over the multiple type air conditioning machine.

FIG. 5 illustrates a control flow for FIG. 4. An example of control over the multiple type air conditioning machine 100 of the embodiment will be described with reference to the flow chart of FIG. 5. Once an operation is started (step S3-1), it is determined in the operation determination unit 161A whether the refrigeration cycle operation can be normally carried out or not, as described above (step S3-2). The step is iterated while the operation is normal and, upon the determination that the operation cannot be normally carried out, it is determined in the refrigerant determination unit 1618 based on the result of the determination whether the refrigerant in the refrigerant circuit is regenerable or not (step S3-3). When it is determined that the refrigerant is regenerable, the control is ended or, when it is determined that the refrigerant is unregenerable, contents of an error are stored in the storage unit 162 (step S3-4), the collecting action prohibition unit 163 prohibits the collection of the refrigerant (step S3-5), and information on the error is outputted to the remote controls 17A, 17B, 17C, 17D, and 171 (step S3-6). After completion of those processes, the control is ended.

The processes of steps S3-4 through S3-6 illustrated in FIG. 5 are not essential and may be omitted is accordance with partial omission from configurations illustrated in FIG. 4.

Figure 6A:
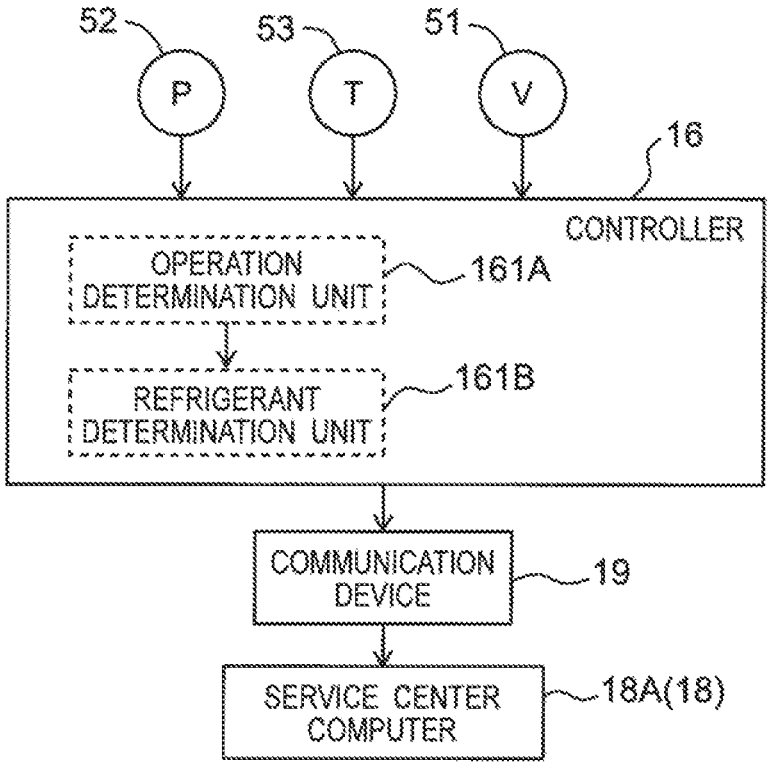
FIG. 6A is a block diagram illustrating a modification to the control section of the multiple type air conditioning machine.

In modification of the embodiment, with reference to FIG. 6A, the communication device 19 may be provided. The communication device 19 transmits information indicating that it has been determined in the controller 16 that the refrigerant is unregenerable, to the computer 18A of the service center that is an external terminal. Communication from and to the communication device 19 is carried out wirelessly. In another modification, as illustrated in FIG. 65, the destination may be the mobile device 18B such as a cellular phone and a smartphone. The external terminal may be such a terminal as a monitoring server 204 that will be described later.

Such provision of the communication device 19 that makes transmissions to the external terminal 18 makes possible to quickly notify the outside that the refrigerant is unregenerable. Besides, the service center can be urged to do the maintenance by notification to the user, the external service provider, or the like. In addition, the information is wirelessly transmitted to the external terminal 18 and thus a degree of freedom of installation of the external terminal 18 can be increased.

In the first embodiment, a cross fin type heat exchanger may be used in place of the outdoor heat exchanger 13. A diameter of refrigerant pipes in the cross fin type heat exchanger may be 5 mm, for instance.

Second Embodiment

Figure 6B:
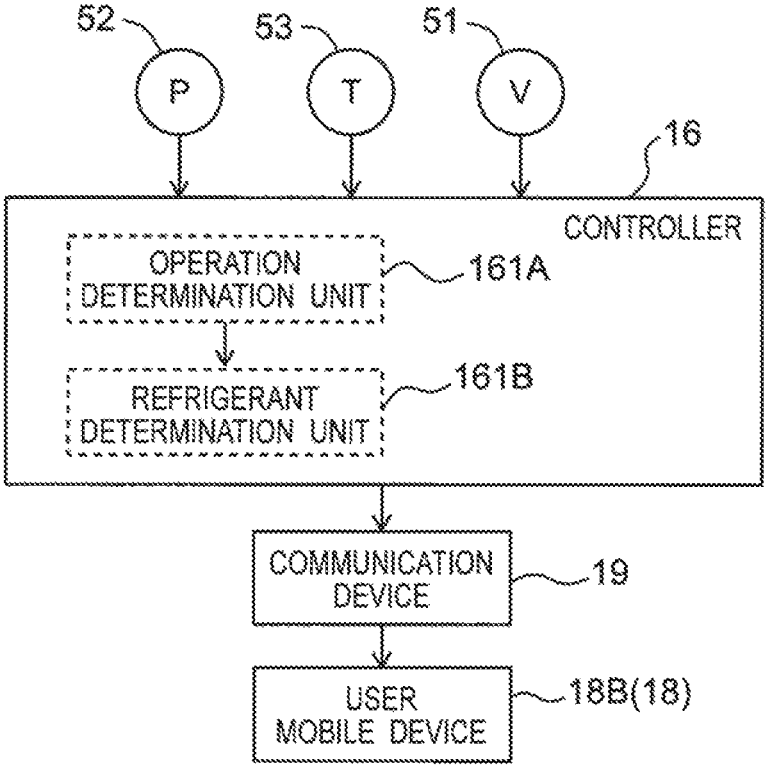
FIG. 6B is a block diagram illustrating a modification to the control section of the multiple type air conditioning machine.
Figure 7:
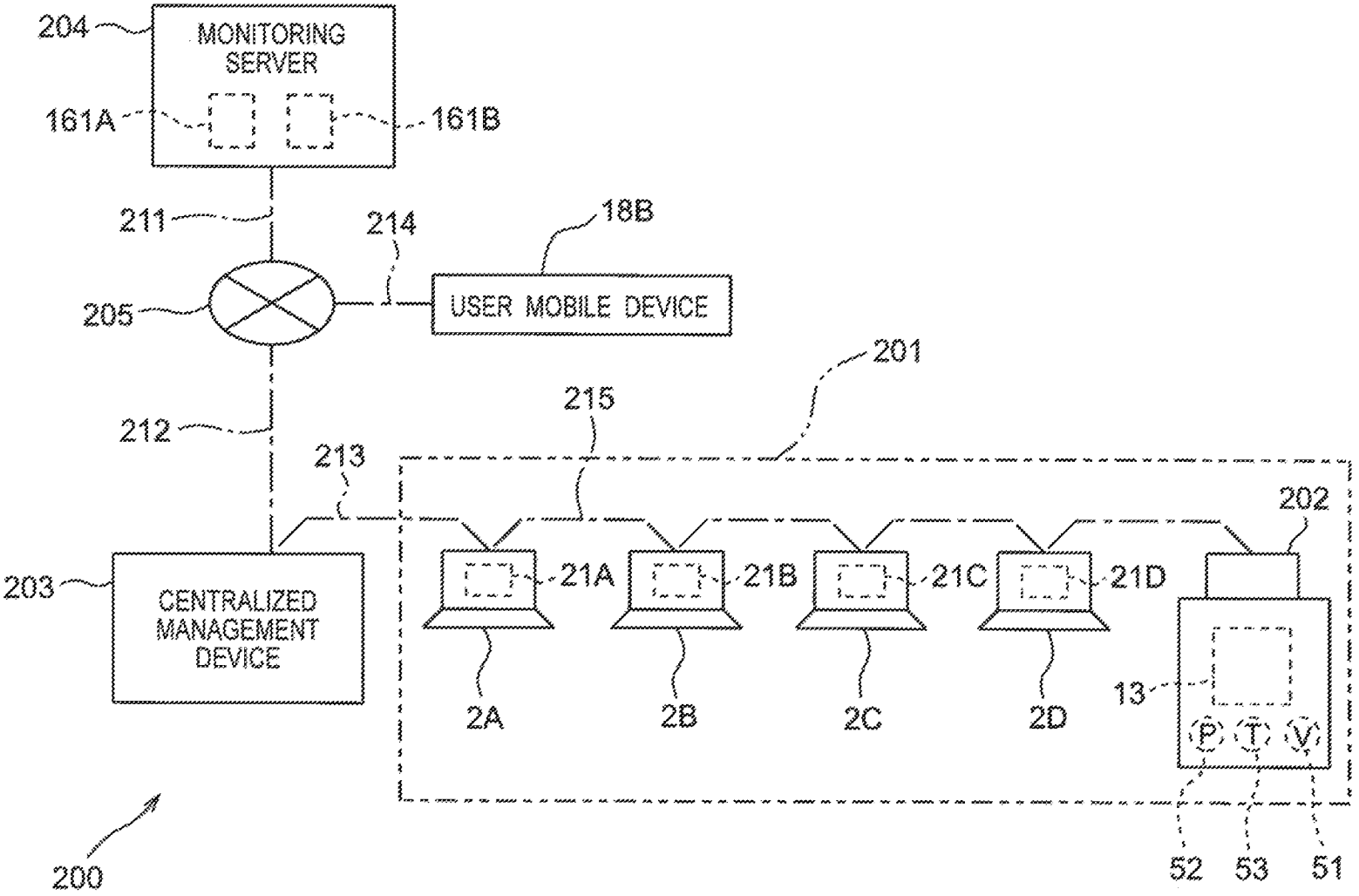
FIG. 7 is a schematic configuration of a determination device in accordance with a second embodiment of the invention.

FIG. 7 is a schematic configuration of a determination device 200 in accordance with a second embodiment of the invention. Components in FIG. 7 that are the same as the components in FIGS. 1, 4, and 6B are provided with the same reference characters as those for the components in FIGS. 1, 4, and 6B. Though not illustrated in FIG. 7, the determination device 200 includes components such as the compressor 11 and the expansion valves 14A, 14B, 14C, 14D, and 14E as with the multiple type air conditioning machine 100 of the first embodiment.

In the determination device 200, in contrast to the first embodiment, the operation determination unit 161A and the refrigerant determination unit 161B are not provided in a multiple type air conditioning machine 201 but provided in the external monitoring server 204. The determination device 200 includes at least the multiple type air conditioning machine 201 and the monitoring server 204. Operating conditions of the multiple type air conditioning machine 201 in accordance with the embodiment are monitored by a centralized management device 203 and, more specifically, the values from the sensors 51 through 53 are monitored, for instance. The centralized management device 203 transmits operating information on the multiple type air conditioning machine 201 through public lines 205 or the like to the monitoring server 204 and the user mobile device 18B. The monitoring server 204 accumulates the received operating information on the multiple type air conditioning machine 201 and makes the above determination by the operation determination unit 161A and the refrigerant determination unit 161B. Those communications are carried out through first through fifth communication lines 211 through 215. The first communication line 211 connects the public lines 205 and the monitoring server 204. The second communication line 212 connects the centralized management device 203 and the public lines 205. The third communication line 213 connects the centralized management device 203 and the multiple type air conditioning machine 201. The fourth communication line 214 connects the public lines 205 and the user mobile device 18B. The fifth communication line 215 connects the indoor units 2A, 2B, 2C, 2D, and 2E and an outdoor unit 202.

In the determination device 200, as described above, the operation determination unit 161A and the refrigerant determination unit 161B do not have to be provided in the multiple type air conditioning machine 201 and may be provided on the outside. Alternatively, either of the operation determination unit 161A and the refrigerant determination unit 161B may be provided in the multiple type air conditioning machine 201 or may be provided on the outside.

REFERENCE SIGNS LIST

1 outdoor unit
2A, 2B, 2C, 2D, 2E indoor unit
3 refrigerant circuit
4A, 4B, 4C, 4D, 4E temperature sensor
11 compressor
12 four-way switching valve
13 outdoor heat exchanger (condenser) (evaporator)
14A, 14B, 14C, 14D, 14E expansion valve (expansion mechanism)
15 receiver
16 controller
17A, 17B, 17C, 17D, 17E remote control
18 external terminal
18A computer of service center
18B mobile device
19 communication device

21A, 21B, 21C, 21D, 21E indoor heat exchanger (condenser) (evaporator)
41A, 41B, 41C, 41D, 41E temperature sensor
51 voltage sensor
52 pressure sensor
53 temperature sensor
100 multiple type air conditioning machine (determination device)
131 flattened tube
132 corrugated fin
133A first header
133B second header
134 first opening
135 second opening
161A operation determination unit
161B refrigerant determination unit
162 storage unit
163 collecting action prohibition unit
200 determination device
201 multiple type air conditioning machine
202 outdoor unit
203 centralized management device
204 monitoring server
205 public line
211 first communication line
212 second communication line
213 third communication line
214 fourth communication line
215 fifth communication line

The invention claimed is:

1. A determination device comprising:

a refrigerant circuit comprising a compressor, a condenser, an expansion valve, and an evaporator which are connected to perform a refrigerant cycle operation; and a controller configured to receive signals from a sensor associated with the compressor while performing the refrigerant cycle operation;

determine, based on the received signals, whether an error has occurred with the refrigeration cycle operation;

determine, upon determination that an error has occurred, whether a refrigerant in the refrigerant circuit is regenerable or not, using the signals received from the sensor and the determined error; and prohibit the compressor from being driven when it is determined that the refrigerant is unregenerable.

2. The determination device as claimed in claim 1, further comprising a memory which stores information indicating that the refrigerant is unregenerable, when it is determined that the refrigerant is unregenerable.

3. The determination device as claimed in claim 1, wherein the determined error is an abnormality relating to the compressor.

4. The determination device as claimed in claim 1, wherein the controller is further configured to wirelessly transmit, using a wireless transmitter, information indicating that the refrigerant is unregenerable, to an external terminal, when it is determined that the refrigerant is unregenerable.

5. The determination device as claimed in claim 4, the determination device being an air conditioning machine, wherein the external terminal is a computer of a service center.

6. The determination device as claimed in claim 1, further comprising a refrigeration collection container detachably provided in the refrigerant circuit and through which the refrigerant passes.

* * * * *